United States Patent [19]

Oger

[11] 3,994,520

[45] Nov. 30, 1976

[54] LOCKING DEVICE FOR ROADWAY MANHOLE COVER

[75] Inventor: Jacques Oger, Pont-a-Mousson, France

[73] Assignee: Pont-A-Mousson S.A., Nancy, France

[22] Filed: Mar. 26, 1975

[21] Appl. No.: 562,156

[30] Foreign Application Priority Data

May 22, 1974 France ..... 74.17871

[52] U.S. Cl. ..... 292/256.73

[51] Int. Cl.[2] ..... E05C 19/18

[58] Field of Search..... 292/256.73, 301, 115, 292/259, 302; 52/19, 20

[56] References Cited

UNITED STATES PATENTS

| | | | |
|---|---|---|---|
| 1,384,712 | 7/1921 | Shanley | 52/20 X |
| 2,663,268 | 12/1953 | Ahnell | 52/19 X |
| 2,915,330 | 12/1959 | Verbiar | 292/256.67 |
| 3,394,836 | 7/1968 | Millard | 292/259 X |
| 3,508,363 | 4/1970 | Crivello et al. | 52/20 |

*Primary Examiner*—Richard E. Moore

*Attorney, Agent, or Firm*—Wenderoth, Lind & Ponack

[57] ABSTRACT

A manhole assembly includes a cover rotatable within a frame to lock the cover therein, the cover being formed with at least one projection extending outwardly of its periphery. The frame is formed with at least one anchorage, and a rod is threaded at one end thereof and has an anchoring formation at the other end thereof. The rod may be engaged between the projection and the anchorage and a nut may be screwed on the threaded end of the rod to move the projection towards the anchorage and lock the cover in the frame.

11 Claims, 11 Drawing Figures

FIG. 7
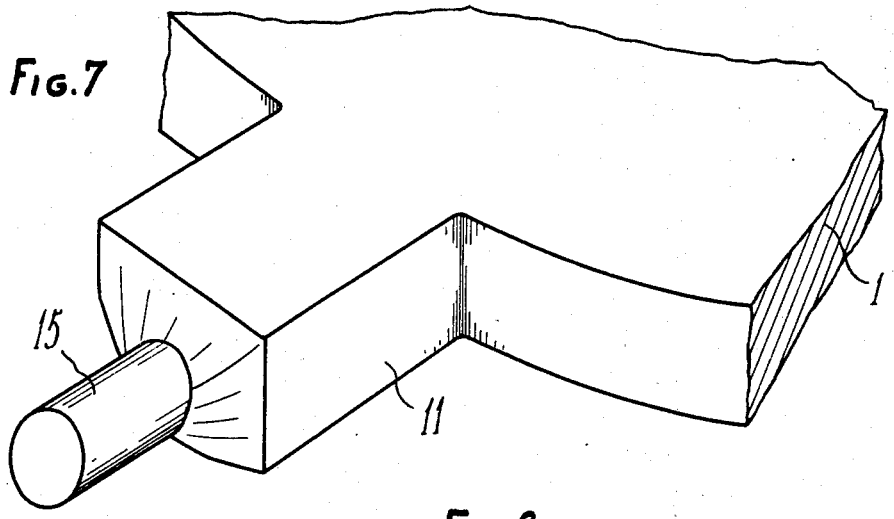
FIG. 8
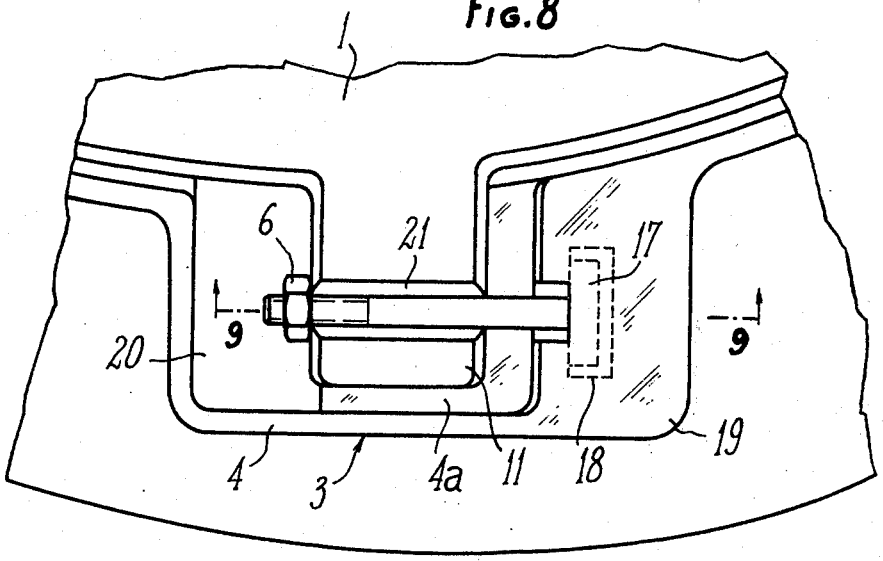
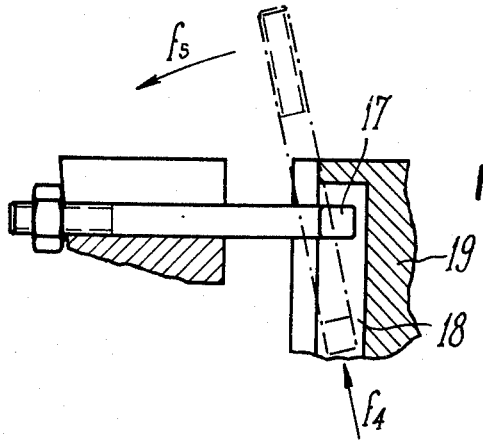
FIG. 9

LOCKING DEVICE FOR ROADWAY MANHOLE COVER

BACKGROUND OF THE INVENTION

This invention relates to manhole assemblies and particularly but not exclusively to a device for the rotational locking of a manhole cover to a manhole frame.

Roadway manholes are known which include a frame on which a cover is firmly secured by tightening means usually including lugs integral with the cover and co-operating with inclined ramps on the frame, rotation of the cover in the direction of tightening having the effect of moving the cover axially towards and into tight engagement with the frame.

It is necessary, in the case of such manholes to provide a device for locking the cover tightly in its final position so as to resist the frequent and large forces resulting from heavy vehicles running on the road. These forces may indeed lead to the cover becoming loosened and displaced from the frame.

Another problem presented by such roadway manhole assemblies is that when the covers are tightened up and locked on to the frame, it is impossible for a person accidentally shut in beneath the cover to unlock the cover

SUMMARY OF THE INVENTION

It is an object of the present invention to provide an improved manhole assembly.

According to one aspect of the present invention there is provided a manhole assembly including a cover rotatable within a frame. The cover is formed with at least one projection extending outwardly of its periphery, and the frame is formed with at least one anchorage. A rod, threaded at one end and having an anchoring formation at its other end, is engaged between the projection and the anchorage, and a nut is screwed on the threaded end to move the projection towards the anchorage and to lock the cover in the frame.

BREIF DESCRIPTION OF THE DRAWINGS

The above and other aspects of the present invention will now be described by way of example with reference to the accompanying drawings, in which:

FIG. 7 is an enlarged perspective view of a portion of the cover of FIG. 5,

FIG. 8 is a plan view of another variation,

FIG. 9 is a partial sectional view along the line 9—9 of FIG. 8,

DETAILED DESCRIPTION OF THE INVENTION

Figure 1:
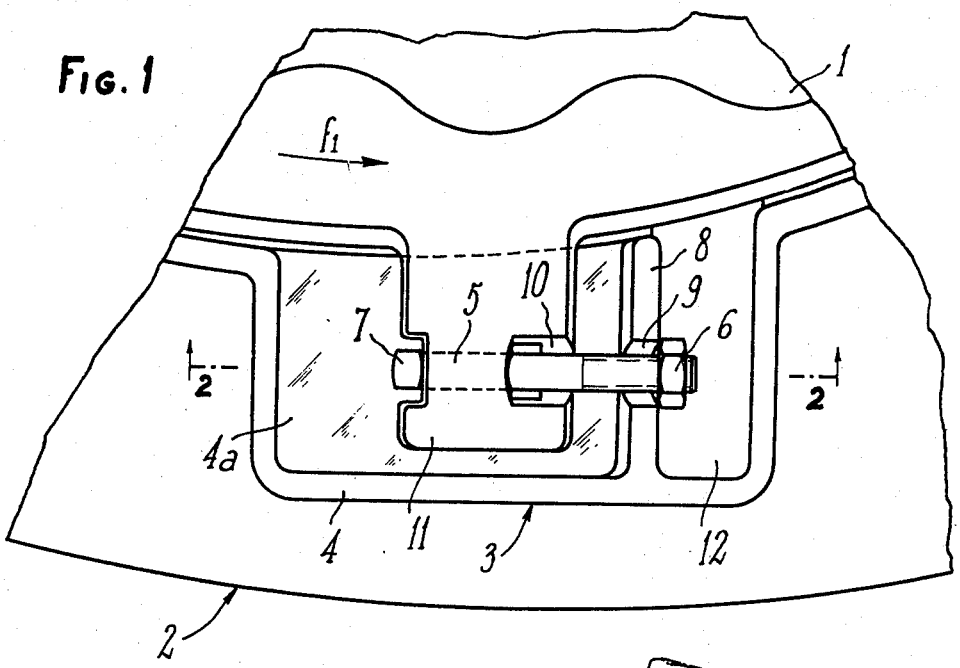
FIG. 1 is a plan view of a device for locking a manhole cover on its frame.

Referring to FIGS. 1 to 4 of the drawings a manhole assembly comprises a cover 1 and a frame 2, the latter having therein at least one outwardly recessed housing a seating or locking box 3 defined by an internal rim 4 of the frame. Locking is effected by a rod 5, threaded at one end to receive a nut 6 and formed at its other end with a hook 7, which makes an angle of slightly less than 90° with the axis of the rod.

The locking box 3 has therein a partition 8, inclined (as shown in FIG. 1) to prevent ejection of the rod 5 and having a recess 9 in its upper portion to receive the rod 5. This rod 5 passes through a hole 10 formed in an outwardly extending bar 11 of the manhole cover 1, and the hooked end 7 of rod 5 bears against a lateral face of bar 11. The nut 6 bears against one face of the partition 8.

A base 4a is provided on one side of the partition 8, and on the other side of the partition there is an opening 12 so that access may be obtained to permit the use of a spanner from below the frame 2 so that the nut 6 can be tightened or loosened.

The hole 10 is formed to provide a lower bearing surface 13 and an upper bearing surface 14, for the rod 5.

Figure 5:
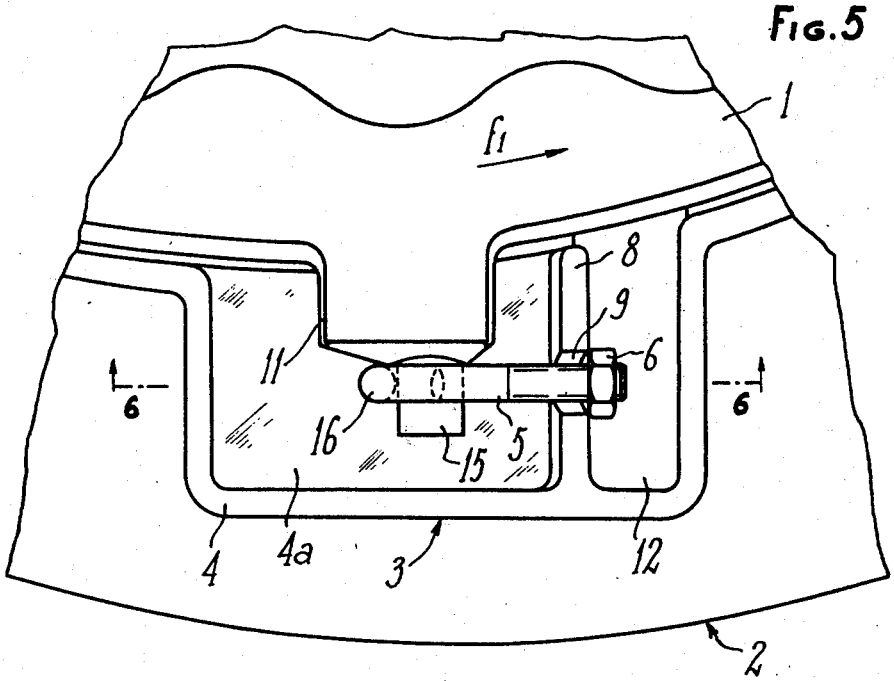
FIG. 5 is a plan view of a variant of the device of FIG. 1.
Figure 6:
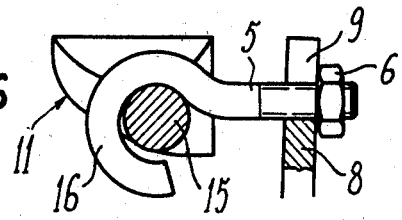
FIG. 6 is a partial sectional view along the line 6—6 of FIG. 5.
Figure 10:
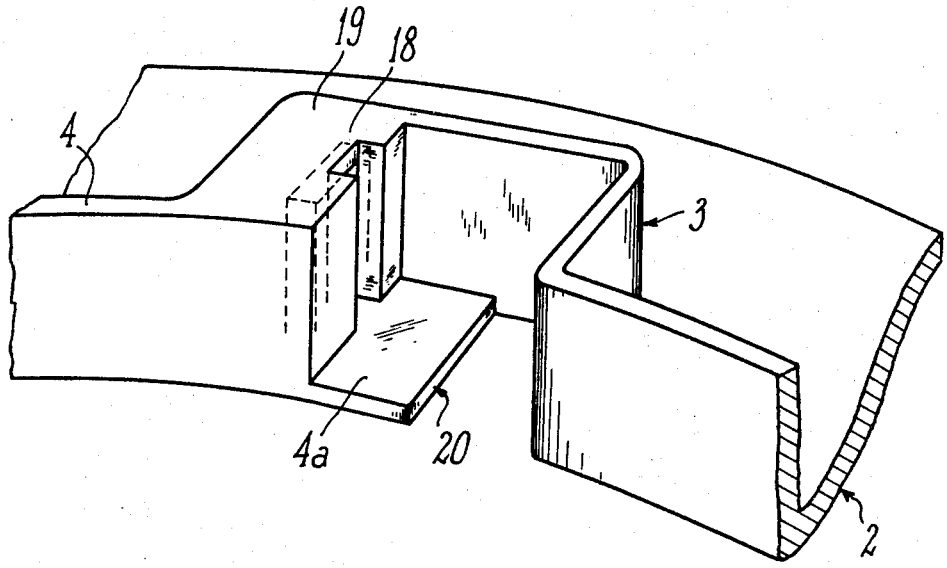
FIG. 10 is an enlarged perspective view of a portion of the frame of FIG. 8.
Figure 11:
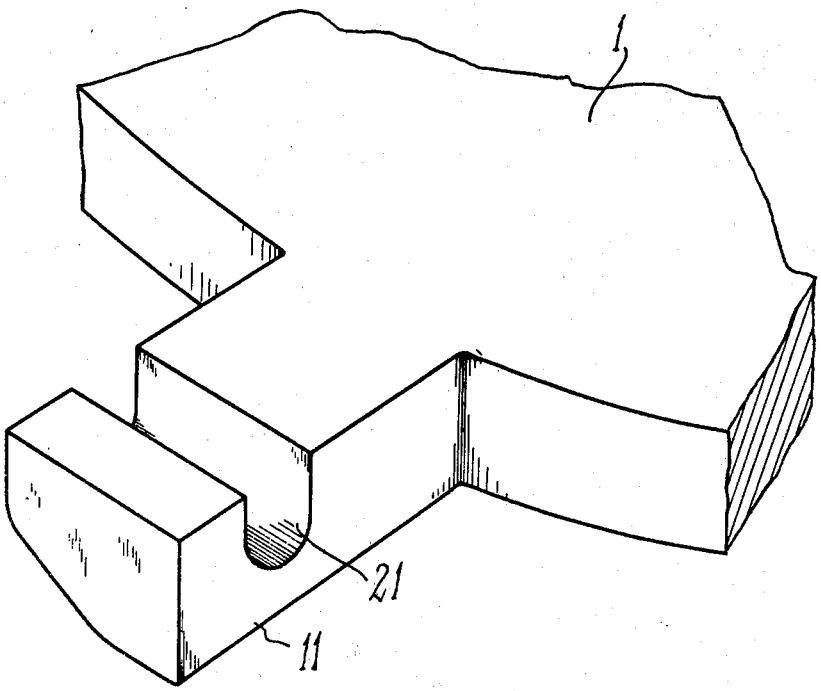
FIG. 11 is an enlarged perspective view of a portion of the cover of FIG. 8.

In FIGS. 5 to 7, the rod 5 comprises a hook 16 in the form of a non-closed circular loop which co-operates with a cylindrical projection 15 on the bar 11. Apart from this, the other elements of this embodiment are identical with those shown in FIGS. 1 to 4.

In operation the bar 11 is disposed inside the locking box 3, and the manhole cover 2 is then turned, by any suitable means, in the direction of the arrow fl, this rotation being in the direction for tightening the cover on to its frame 2, for example by means of lower lugs (not shown) on the manhole cover co-operating with lower inclined ramps (not shown) on the frame 2.

Figure 2:
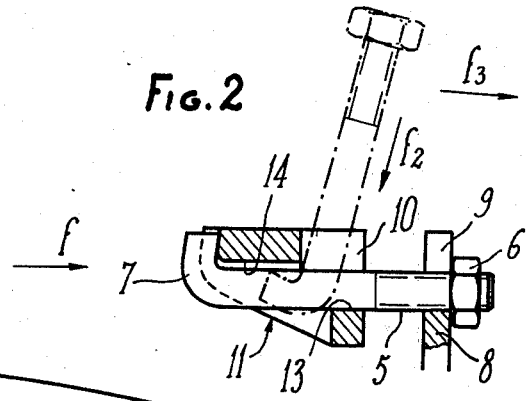
FIG. 2 is a partial sectional view along the line 2—2 of FIG. 1.
Figure 3:
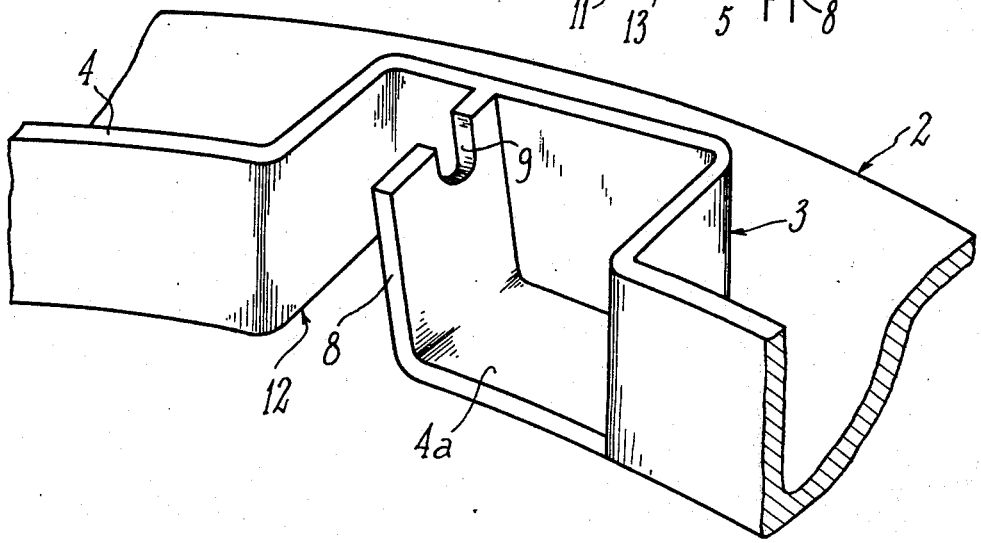
FIG. 3 is an enlarged perspective view of a portion of the frame of FIG. 1.
Figure 4:
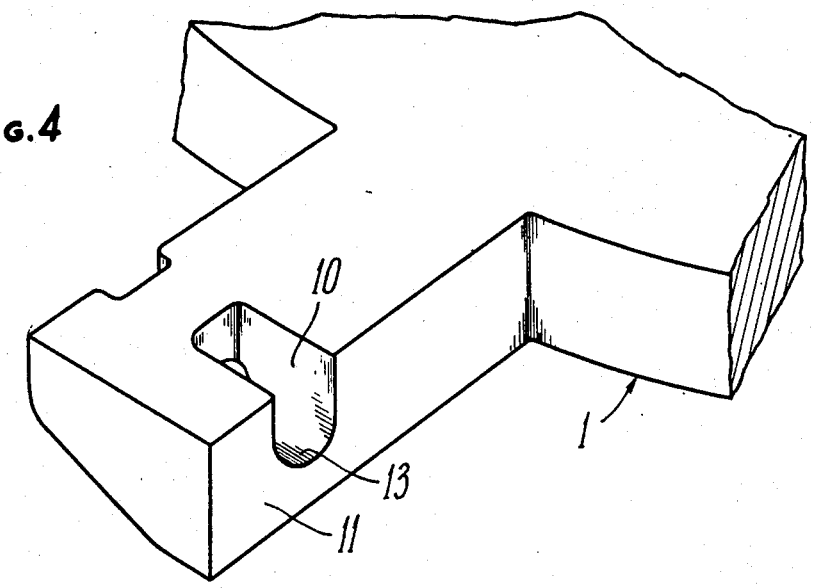
FIG. 4 is an enlarged perspective view of a portion of the cover of FIG. 1.

The rod 5 is then introduced, without its nut 6 into the hole 10 of the bar 11 in the direction of the arrow f (FIG. 2) and, when its threaded end has passed beyond the recess 9, the nut 6 is screwed on to it and tightened. In FIG. 2 broken lines have been used to indicate the position of the rod 5 which enables it to be used as a lever for obtaining coarse tightening of the manhole cover. For this purpose, the end 7 of this rod 5 is introduced into the hole 10 of the bar (arrow f2) and its free end is urged in the direction of the arrow f3.

The nut 6 is then tightened with a spanner, which may be offered up either from above or from below the frame through the opening 12 formed in the base of the box 3. The bar 11 now turns in the direction of the arrow f1, and thus the final tightening up and locking of the manhole cover is achieved.

For dismantling, the above described operations are executed in the reverse order and the various movements in the opposite directions. The nut 6 can remain permanently attached to the rod 5.

The assembling and dismantling of the arrangement of FIGS. 5 to 7 is similar to that shown in FIGS. 1 to 4. At the commencement of the operation, the hook 16 is passed around the cylindrical projection 15 of the bar 11, before the manhole cover is placed on the frame, the open end of this hook being oriented downwards.

Reference will now be made to FIGS. 8 to 11 which illustrate a variant of this invention.

The threaded end of the rod 5 is situated on one side of the bar 11 and receives the nut 6, the other end 17 being in the form of a T and being disposed inside a vertical slot 18 provided in a solid portion 19 of the locking box 3. The slot 18 is T-shaped and opens into the lower part of the frame 2 but is not open at its upper end, so that the rod is obstructed in an upward direction. The base of the box 3 is formed with an opening 20, to permit a tightening tool to be passed in from below the frame 2. In this case, the bar 11 is formed with a transverse groove 21 for receiving the rod 5.

In operation the threaded portion of the rod 5, with the nut 6 removed, is introduced through the base of the frame 2 in the direction of arrow f4 (FIGS. 9 and 11) into the T-slot 18 of the locking box 3. This threaded portion projects outwardly of the upper part of the slot 18 and receives the nut 6. With the bar 11 in the coarsely tightened up position, the rod is folded down in the direction of arrow f5 (FIG. 9) to become seated in the groove 21 in such a way that the nut 6 bears against one face of the handling bar 11.

Dismantling is carried out in the reverse manner, the nut 6 is left on the rod in such a way that the rod cannot move out of its seating and can be gripped when installation is again to be carried out.

It will be understood that by using a device according to this invention, it is readily possible to achieve effective and reliable rotational locking of the manhole cover in the position of maximum tightness as a result of the rod 5 bearing, at one end thereof, upon the bar 11 of the cover bearing, at the other end thereof, on an element 8 or 18 of the locking box 3.

In addition the nut 6 may be loosened from below the manhole cover through the openings 12 or 20, which is of particular importance should a person be imprisoned beneath the cover.

The rod 5 at the commencement of installation may also be used to turn the manhole cover on the manhole, and thus carry out a coarse tightening of this cover. Also the operation of placing the locking hook in position is easily and rapidly carried out and it is impossible to lose the rod 5, even if the nut 6 is lost, so long as the locking bar of the cover is inside the box 3.

The arrangements of FIGS. 5 to 11 provide simplification with manufacture by casting of the bar of the manhole cover, due to end 15 (FIGS. 5 to 7), and particularly good fixing of the locking rod to the frame as a result of the T-slot 18 of the locking box and of the correspondingly shaped head 17 of the locking rod (FIGS. 8 to 11). In addition the groove 21 enables the locking bar to be cast with the cover.

It will also be understood that a lid may be provided covering the whole locking box 3 and intended firstly to prevent foreign bodies from entering therein and, secondly, to prevent the box from offering, at the surface of the roadway, hollow or roughened portions.

It is also possible to use the device of this invention with a manhole cover frame not fitted with a box 3. In this case, the rod 5 and its nut 6 co-operate with the manhole cover and with a projection on the frame proper.

What I claim is:

1. A manhole assembly comprising:

a manhole frame having an opening therein;

a manhole cover rotatably received in said frame to a closed position closing said opening, said cover having at least one substantially radially outwardly extending projection;

said frame having at least one anchorage; and means removably engagable between said projection and said anchorage for urging said projection toward said anchorage while rotatably moving said cover to said closed position closing said opening, and for locking said cover in said closed position, said urging and locking means comprising a rod having at a first end thereof an anchoring formation and being threaded at a second end thereof, and a nut adjustably threaded on said threaded end of said rod, said anchoring formation removably engaging one of said projection and said anchorage, and said nut abutting the other of said projection and said anchorage, said rod being substantially parallel to the plane of said cover when in a position locking said cover in said closed position.

2. An assembly as claimed in claim 1, wherein, when said cover is locked in said closed position, said nut is accessible from both above and below said cover.

3. An assembly as claimed in claim 1, wherein said frame has therein at least one outwardly recessed housing, said anchorage being within said housing, and said projection extending into said housing when said cover is in said closed position.

4. An assembly as claimed in claim 3, wherein said housing has a base with an opening therein forming means to permit access to said nut from below said assembly.

5. An assembly as claimed in claim 3, further comprising a lid covering said housing.

6. An assembly as claimed in claim 3, wherein said anchorage comprises a partition within said housing at an intermediate peripheral position thereof, said partition having an upper end thereof a recess receiving said threaded end of said rod when in said position locking said cover in said closed position with said nut abutting said partition, said partition being inclined upwardly in a direction away from said projection.

7. An assembly as claimed in claim 1, wherein said anchoring formation comprisies a hook removably engagable with said projection.

8. An assembly as claimed in claim 7, wherein said projection has thereon a cylindrical member, and said hook removably engagable over said cylindrical member.

9. An assembly as claimed in claim 7, wherein said projection has therein an aperture with upper and lower bearing surfaces, said rod being removably extendable through said aperture, said hook being disposed at an angle of less than 90° to the remainder of said rod.

10. An assembly as claimed in claim 1, wherein said anchoring formation comprises a T-shaped member, and said anchorage comprises a T-shaped slot in said frame and complementarily shaped with respect to said T-shaped member, said T-shaped member being removably received in said T-shaped slot.

11. An assembly as claimed in claim 10, wherein said T-shaped slot is open on a lower side of said frame and closed on an upper side of said frame, and said projection has an upper surface thereof a transverse slot receiving said rod.

* * * * *